United States Patent [19]

Ogura et al.

[11] Patent Number: 4,457,672

[45] Date of Patent: Jul. 3, 1984

[54] FAN WITH VARIABLE AXIS IMPELLER

[75] Inventors: Masato Ogura; Noriyasu Horio, both of Gifu, Japan

[73] Assignee: Mitsubishi Denki Kabushiki Kaisha, Tokyo, Japan

[21] Appl. No.: 329,473

[22] Filed: Dec. 10, 1981

[30] Foreign Application Priority Data

Mar. 23, 1981 [JP] Japan ..... 56-41906
Mar. 27, 1981 [JP] Japan ..... 56-43046[U]
Mar. 30, 1981 [JP] Japan ..... 56-44775[U]

[51] Int. Cl.[3] ..... F04B 17/00; F04B 35/04; F04D 29/56

[52] U.S. Cl. ..... 417/360; 417/361; 417/423 R; 417/424; 415/125; 415/126; 248/27.1; 248/343; 248/660

[58] Field of Search ..... 417/360, 423 R, 361, 417/424; 415/126, 125; 248/27.1, 342, 343, 660, 661, 664, 665

[56] References Cited

U.S. PATENT DOCUMENTS

| | | | |
|---|---|---|---|
| 1,135,257 | 4/1915 | Carlin | 248/660 |
| 1,316,907 | 9/1919 | McEwen | 248/661 |
| 1,824,682 | 9/1931 | O'Neil | 248/343 |
| 2,224,628 | 12/1940 | Benson | 415/126 |
| 2,594,688 | 4/1952 | Shapiro | 415/126 |
| 2,620,722 | 12/1952 | Owens | 417/423 R |
| 2,776,089 | 1/1957 | Burrowes et al. | 417/360 |
| 2,824,429 | 2/1958 | Zucker | 98/120 |
| 3,172,365 | 3/1965 | Nasvytis | 417/360 |
| 4,350,472 | 9/1982 | Morimoto | 415/209 |

FOREIGN PATENT DOCUMENTS

| | | | |
|---|---|---|---|
| 201046 | 7/1923 | United Kingdom | 248/664 |

*Primary Examiner*—William L. Freeh
*Assistant Examiner*—Paul F. Neils
*Attorney, Agent, or Firm*—Sughrue, Mion, Zinn, Macpeak and Seas

[57] ABSTRACT

A fan assembly has a main body support and a mounting member which are inclined at a predetermined angle thus permitting the fan assembly to be mounted either adjacent to the upper edge of a wall or in a corner of a ceiling. A rotating grill disperses a current of air over a relatively wide area. The main body support has a groove which accommodates a mating engageable member of the mounting member thus permitting the fan assembly to be securely mounted to a wall or a ceiling.

9 Claims, 10 Drawing Figures

FAN WITH VARIABLE AXIS IMPELLER

BACKGROUND OF THE INVENTION

1. Field of the Invention

The present invention relates to a fan which can be selectively mounted to both a ceiling and a wall.

2. Description of the Prior Art

Prior art ceiling fans are designed for mounting exclusively on a ceiling, and wall fans on a wall. They are not interchangeable. In addition in some fans, the electric motor is mounted on a support rather than the impeller casing. The support is then secured to the casing by screws, and the support is adapted for mounting on the ceiling or wall. Since the casing is usually formed from a synthetic resin, it is generally not strong enough to support the screws and very often breaks resulting in the fan falling down.

Such a mounting system is described in Japanese Utility Model Publication Nos. 134442/77 and 139522/79. In the former publication, a fixing means is adapted to be fixed only to a wall and, in the latter, a fixing means is adapted to be fixed only to a ceiling. The fan supports, housing the electric motors, are then connected to the fixing means. Therefore, not only is there a high risk that the fan may separate from the support due to stresses imposed while operating the fan, these prior art fans cannot individually be selectively mounted to either a ceiling or a wall.

In addition, in order to forcefully blow air over a relatively large area, in some fans the main body is rotatably mounted on a base attached to a ceiling or wall, so that when the main body rotates, the fan delivers a current of air over an enlarged area. However, such fans require relatively large amounts of space within which they may rotate thereby precluding them from being mounted adjacent to an upper edge of a wall or in a corner of a ceiling.

Other fans incorporate a grill having members that alter the direction of air flow from an impeller. The grill rotates thus distributing air flow over a wide area. Such a fan is described in British Pat. No. 1,251,880. However, these types of fans are not suitable for mounting at the upper edge of a wall or in the corner of a ceiling since the direction of the air flow from the fan cannot be controlled within a predetermined range.

SUMMARY OF THE INVENTION

It is therefore an object of the present invention to provide a fan which can be mouned to either a ceiling or a wall;

It is a further object to provide a fan which has a relatively small chance of separating from its support;

It is yet a further object to provide a fan which can deliver a current of air at an angle which is variable within a predetermined range;

A yet further object of the present invention is to provide a fan designed for mounting interchangeably on either a ceiling or a wall; and having a grill, a grill mounting leg and an impeller which are all removable so that they may easily be cleaned or repaired.

These and other objects of the invention are attained by providing a fan assembly comprising a casing having a front surface and a rear surface that define an air passage therebetween, an electric motor mounted on the casing, an impeller that is rotated by the motor, a grill located over the front surface of the casing for altering the direction of a current of air produced by the impeller, a main body support located over the rear surface of the casing, and a mounting member with which the main body support is engageable for securing the fan assembly to either a ceiling or a wall.

The main body support and the mounting member have surfaces which are inclined at a predetermined angle. Since the fan assembly can be mounted at a predetermined angle, it is possible to obtain a current of air over a sufficiently wide area even if the fan assembly is mounted adjacent to the upper edge of a wall or in a corner of a ceiling. In addition, the fan is easily disassembled thus permitting easy cleaning of the assembly.

DESCRIPTION OF THE PREFERRED EMBODIMENTS

This invention will now be described by way of example with reference to FIGS. 1 to 10.

Figure 1:
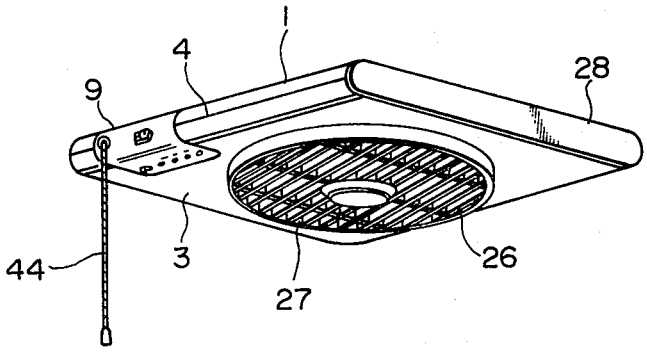
FIG. 1 is a perspective view of a fan of the present invention.
Figure 4:
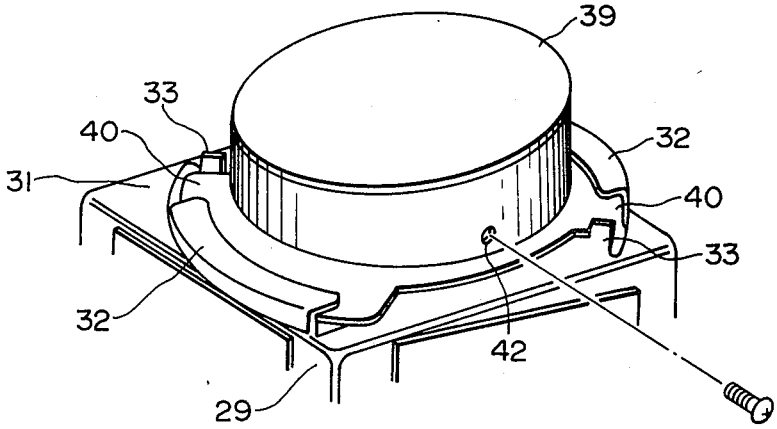
FIG. 4 is a view showing the support 29 and the mounting member 39 put together.
Figure 2:
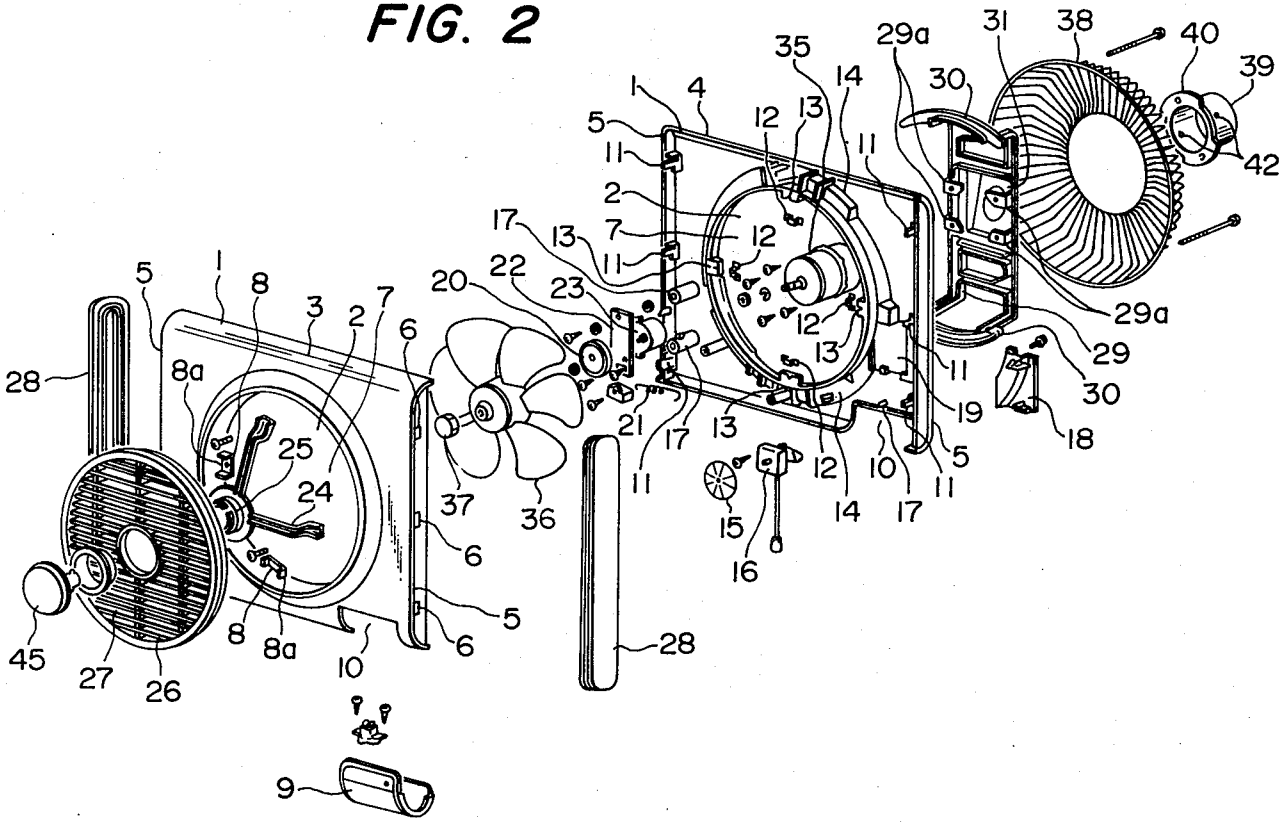
FIG. 2 is an exploded perspective view of the fan shown in FIG. 1.
Figure 3:
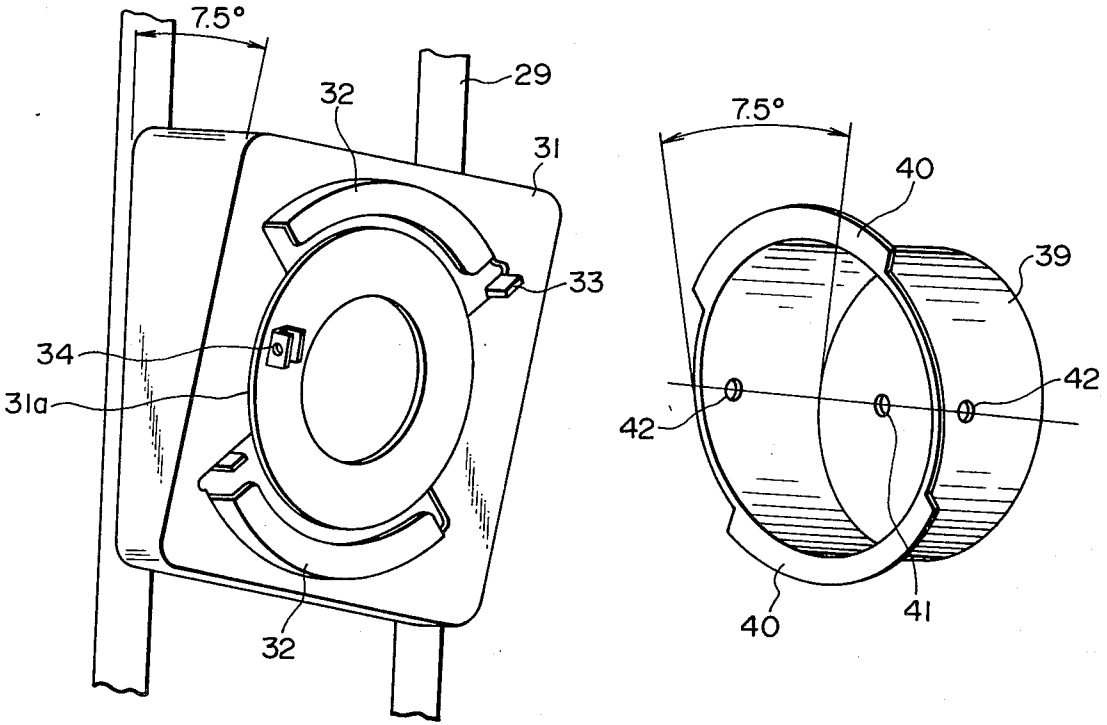
FIG. 3 is a fragmentary enlarged perspective view showing the support 29 and the mounting member 39 separately.

Referring to FIG. 2, a casing 1 has a front surface and a rear surface between which an air passage 2 is defined. The casing 1 comprises a front casing portion 3, and a rear casing portion 4. The front casing portion 3 is formed with a groove 5 along each of a pair of vertical edges and a number of holes 6 in each groove 5. In the center of the front casing portion 3 is an air passage opening 7 having a peripheral wall provided with a plurality of fitting members 8 each having a hole **8*a*. In the bottom of the front casing portion 3 is a recess 10 for accommodating a switch panel 9**.

The rear casing portion 4 also has a pair of grooves 5, an air passage opening 7, and a recess 10. The rear casing portion 4 is provided with a plurality of latching members 11 which are engageable with the holes 6 in the grooves 5 of the front casing portion 3.

The air passage opening 7 has a peripheral wall provided with a plurality of fitting members 13 aligned with the fitting members 8 on the front casing portion 3, and each is adapted to receive a threaded member 12. The rear casing portion 4 has a rear surface formed with a pair of curved shoulders **14*a* (FIG. 9) and a pair of vertically spaced part, curved grooves 14 with which a support is engageable as will hereinafter be described. Each of the grooves 14 has a predetermined radius of curvature, and extends along about half of the length of one of the shoulders 14*a*. Each groove 14 is formed in its mid-portion with a threaded hole 14*b***.

The rear casing portion 4 has a front surface provided with a number of bosses 17 (FIG. 2) on which a changeover switch 16 having a speed indicator 15 is mounted, and on which an electric motor 23 for grill rotation is mounted by a slidable mounting plate 22 urged by a spring 21. A sidewall of the electric motor 23 contacts a roller 20. The rear casing portion 4 has an opening 19 provided for mounting a terminal block 18 therein.

A grill mounting leg 24 is threadedly secured to the fitting members 8, and has a shaft 25 in its center. A grill 26 is rotatably supported on the shaft 25, and has a plurality of spaced apart blades 27 positioned at different angles for varying the direction of a current of air. The grill 26 has an outer peripheral edge maintained in contact with the roller 20 which is rotated by the motor 23. A grill knob 45 engages the shaft 25 to hold the grill 26 thereon. A pair of side edge covers 28 engage the groove 5 of the front and rear casing portions 3 and 4 when put together.

The support 29 has a pair of curbed engaging members 30 adapted to be received in the grooves 14 of the rear casing portion 4, and each has a threaded hole **30*a* which is alignable with the threaded hole 14*b* in one of the grooves 14. A number of motor mounting legs 29*a* are formed integrally on the support 29. The support 29 has a rear surface 31 inclined at an angle of 7.5° to its front surface. The inclined surface 31 has a pair of vertically spaced apart, arcuately curved engaging flanges 32 each having an L-shaped cross section, and an angle of nearly 90°. A stop 33 is adjacent to one end of each engaging flange 32, and a fitting member 34 is located between an adjacent pair of ends of the engaging flanges 32. The fitting member 34 has a threaded hole. The inclined surface 31 is formed centrally with a circular projection 31*a* on which the fitting member 34 is provided. A second electric motor 35 is mounted on the motor mounting legs 29*a*. The motor 35 has an output shaft to which an impeller 36 is attached by a securing knob 37. A guard 38** covers the rear of the casing.

A pan-shaped mounting member 39, which can fit about the circular projection **31*a*, has a pair of diametrically opposite arcuate flanges 40 which are engageable with the L-shaped flanges 32 on the rear surface 31 of the support 29. Each flange 40 has an angle of about 90° relative to the center of the circle which it defines. The mounting member 39 has a bottom formed with a number of holes 41 for accommodating screws for securing the fan to the ceiling or wall of a room, and also has a sidewall formed with a pair of threaded holes 42, each of which is alignable with the threaded hole of the fitting member 34. The flanges 40 lie in a plane inclined at an angle of 7.5° to the bottom of the mounting member 39. The switch panel 9 has a string 44** for switch operation.

The fan as hereinabove described is assembled as will hereinafter be set forth. The motor 35 is secured by screws to the motor mounting legs **29*a* on the support 29. The engaging members 30 of the support 29 are aligned with the shoulders 14*a* of the rear casing portion 4, and rotated into engagement with the grooves 14. Screws are passed through the threaded holes 14*b* and 30*a* to connect the support 29 to the rear casing portion 4. These procedures are reversed for disassembling purposes. The changeover switch 16 and the terminal block 18 are secured by screws to the bosses 17 on the rear casing portion 4. The roller 20 is mounted to the motor 23 for grill rotation, and the motor 23 is mounted to the mounting plate 22. One end of the mounting plate 22 is rotatably screwed down, while the other end thereof has an elongated hole which receives a boss 17 to permit sliding movement of the other end of the mounting plate 22 to which the spring 21 is fastened. The impeller 36 is secured to the motor 35 by the securing knob 37. The front casing portion 3 is joined to the rear casing portion 4. The side edge covers 28 are engaged with the grooves 5, and the switch panel 9 is fitted into the recesses 10. The latching members 11 are engaged with the holes 6. The grill mounting leg 24 is secured to the fitting members 8 by the screws passed therethrough and engaged with the threaded members 12. The grill is fitted on the shaft 25, and the knob is engaged with the shaft 25. Finally, the guard 38** is fitted into position, thus completing the assembly of the fan.

Figure 5:
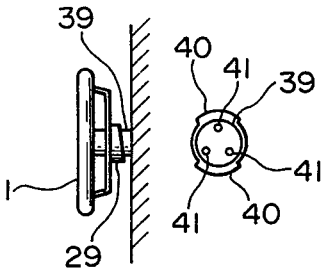
FIGS. 5 and 6 are side elevational views showing the fan mounted on a wall or ceiling, respectively, with its casing 1 lying parallel thereto.
Figure 6:
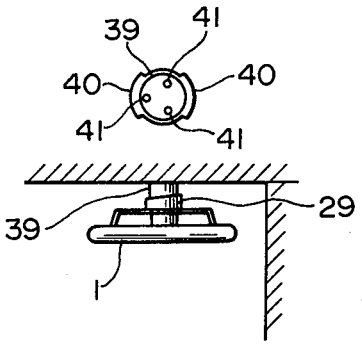

The fan thus assembled may be mounted to the ceiling or wall of a room as will hereinafter be described. The mounting member 39 is secured to the ceiling or wall by screws passing through the holes 41. The inclined rear surface 31 of the support 29 is brought into contact with the flanges 40 of the mounting member 39, while the mounting member 39 is fitted about the circular projection **31*a* on the inclined surface 31. The flanges 32 on the inclined surface 31 are displaced by 90° relative to the flanges 40 on the mounting member 39. The support 29, hence the fan assembly as a whole, is rotated by 90° around the circular projection 31*a* until the flanges 40 abut on the stops 33, whereby the threaded hole of the fitting member 34 is aligned with one of the threaded holes 42. The support 29 and the mounting member 39 are fixed to each other by a screw passing through those threaded holes aligned with each other, and the fan is mounted to the ceiling or wall so that the shaft of the motor 35 may lie horizontally or vertically as shown in FIGS. 5 or 6**.

Figure 7:
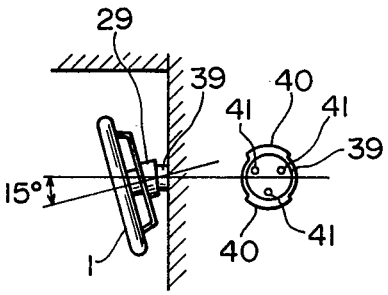
FIGS. 7 and 8 are side elevational views showing the fan mounted with its casing 1 inclined at an angle of 15° to the wall or casing.
Figure 8:
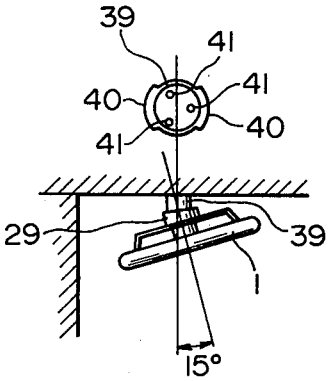
Figure 9:
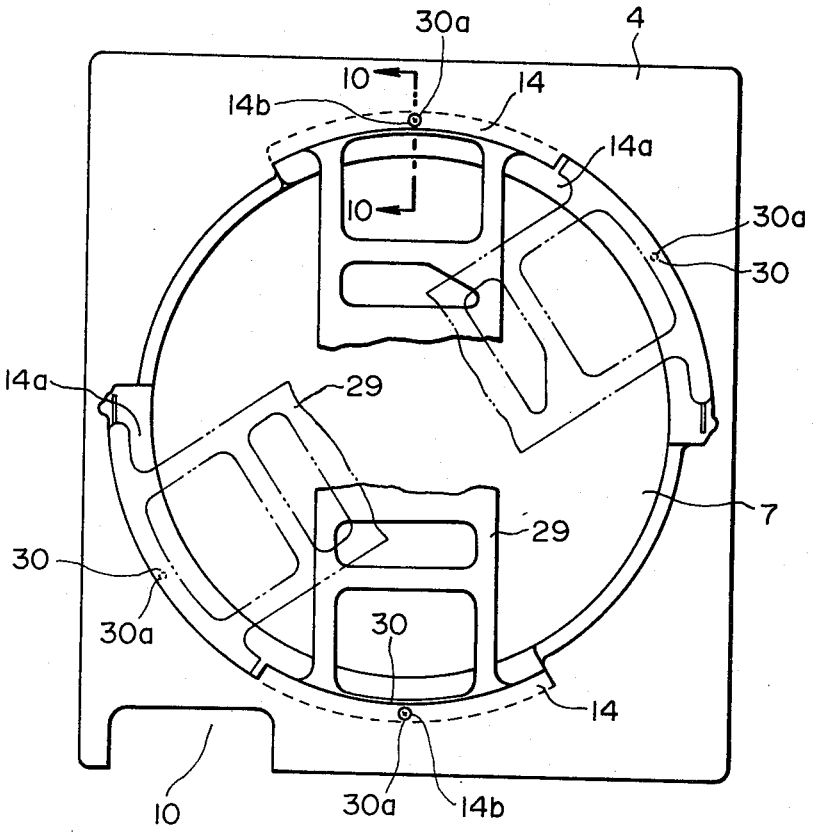
FIG. 9 is a fragmentary enlarged top view showing the relationship between the rear casing portion 4 and the support 29.
Figure 10:
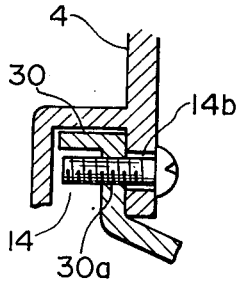
FIG. 10 is a sectional view taken along the line 10—10 of FIG. 9.

If the mounting member 39 is secured to the wall in a position displaced by 180° from its position described above, the fan can be inclined by an angle of 15° to the horizontal or vertical as shown in FIGS. 7 or 8, since both the support 29 and the mounting member 39 are inclined at an angle of 7.5°.

If the changeover switch 16 is turned to its ON position, the motor 35 is placed in operation, and the impeller 36 is driven to deliver a current of air at an angle defined by the deflector blades of the grill 26. If the motor 23 for grill rotation is driven, the roller 20 causes the grill 26 to rotate about its shaft 25, whereby a current of air is delivered over an enlarged area. If the relative angle between the support 29 and the mounting member 39 is appropriately selected, it is possible to mount the fan assembly at an angle which best suits the environment in which it is mounted.

As hereinabove described, the fan assembly of this invention comprises a casing having a front surface and a rear surface which define an air passage therebetween, an electric motor mounted on the casing, an impeller adapted for rotation by the motor, a grill provided over the front surface of the casing for altering the direction of a current of air produced by the impeller, a main body support provided on the rear surface of the casing, and a mounting member with which the main body support is engageable for securing the fan assembly to a ceiling or wall, the main body support and the mounting member having mating surfaces which are inclined at a predetermined angle. The fan assembly can, therefore, be mounted on both a ceiling and a wall. Since the fan assembly can be mounted in an inclined position at a predetermined angle, it is possible to obtain a current of air over a sufficiently wide area, even if the fan is mounted adjacent to the upper edge of a wall or in a corner of a ceiling. There is advantageously no limitation to the position in which the fan can be installed on a ceiling or wall.

Further, the fan of this invention permits easy cleaning of the impeller, grill, interior of the casing, etc., since the grill and the grill mounting leg are removably attached to the casing, and the impeller is removably attached to the motor, as hereinabove described. This advantage is particularly important when the fan is mounted at a high level, such as on a ceiling or wall.

Further, according to the invention, the fan casing is formed with grooves of predetermined length, and the support includes engaging members which are rotatable into engagement with those grooves, as has hereinabove been described. The grooves and the support as a whole contribute to supporting the casing, etc. rigidly. This arrangement provides such a high degree of strength that there is no longer any possibility of any threaded portion being broken, and the casing or the like falling down.

While the invention has been described in detail and with reference to a specific embodiment thereof, it will be apparent to one skilled in the art that various changes and modifications can be made therein without departing from the spirit and scope of the invention.

We claim:

1. A fan assembly comprising:
- a casing having a front surface and a rear surface which define an air passage therebetween;
- a first electric motor;
- an impeller adapted for rotation by said motor;
- a grill located over said front surface of said casing for altering a direction of a current of air produced by said impeller;
- a main body support located on said rear surface of said casing; and
- a mounting member for securing said fan assembly to a ceiling or wall;
- means for fixedly engaging said mounting member to said main body support in any one of a plurality of positions to prevent movement therebetween, said main body support and said mounting member having mating surfaces which are inclined at a predetermined angle, each of said predetermined positions defining a unique and fixed spacial orientation of an axis of said impeller.

2. The fan assembly as claimed in claim 1, further comprising motor mounting leg means located on said main body support, said first electric motor being secured to said motor mounting leg means, and a grill mounting leg for securing said grill to said front surface of said casing, said grill and said grill mounting leg being removably attached to said casing, and said impeller being removably attached to said motor.

3. The fan assembly as claimed in claim 1, wherein said rear surface of said casing has an arcuate groove of predetermined length therein, and said main body support includes an engaging member which is rotatable in said groove.

4. A fan as set forth in claim 3, wherein said groove and said engaging member have a predetermined radius of curvature.

5. The fan assembly as claimed in claim 3, further comprising motor mounting leg means located on said main body support, said first electric motor being secured to said motor mounting leg means, and a grill mounting leg for securing said grill to said front surface of said casing, said grill and said grill mounting leg being removably attached to said casing, and said impeller being removably attached to said motor.

6. The fan assembly as set forth in claim 1, further comprising a second electric motor mounted on said casing for rotating said grill.

7. The fan assembly as set forth in claim 6, wherein said mating surfaces are inclined at the same angle.

8. The fan assembly as set forth in claim 6, further comprising motor mounting leg means on said main body support for mounting said first motor.

9. The fan assembly as set forth in claim 1, 6, 7 or 8 wherein said fixedly engaging means comprises an L-shaped engaging member, and an engaging flange which is engaged with said engaging member, said engaging member being located on one of said main body support and said mounting member while the other of said main body support and said mounting member has said engaging flange located thereon.

* * * * *